United States Patent [19]

Okamoto et al.

[11] Patent Number: 4,916,958

[45] Date of Patent: Apr. 17, 1990

[54] PINION STOPPER OF ENGINE STARTER

[75] Inventors: Kyoichi Okamoto; Kazuo Takami, both of Hyogo, Japan

[73] Assignee: Mitsubishi Denki Kabushiki Kaisha, Tokyo, Japan

[21] Appl. No.: 259,388

[22] Filed: Oct. 18, 1988

[30] Foreign Application Priority Data

Nov. 2, 1987 [JP] Japan ..... 62-168233
Nov. 2, 1987 [JP] Japan ..... 62-168234

[51] Int. Cl.[4] ..... F02N 15/02

[52] U.S. Cl. ..... 74/6; 74/7 R; 403/19; 403/326

[58] Field of Search ..... 74/6, 7 R; 123/179 M; 403/19, 326

[56] References Cited

U.S. PATENT DOCUMENTS 2,487,579 11/1949 Miller ..... 74/7 R
3,124,694 3/1964 Seilly ..... 74/7 R
4,440,033 4/1984 Kurihara et al. ..... 74/7 R

*Primary Examiner*—Leslie A. Braun
*Assistant Examiner*—Scott Anchell
*Attorney, Agent, or Firm*—Sughrue, Mion, Zinn, Macpeak & Seas

[57] ABSTRACT

At least one axial groove is formed on an output shaft which extends from an end of the output shaft to a stop ring groove and has a depth substantially equal to that of the stop ring groove to allow a stop ring fitted therein to be pushed up by a pin or the like inserted along the axial groove into the stop ring groove. A stop ring groove may be formed in a position on the output drive shaft adjacent to an end thereof, and an extension of a pinion drive shaft is provided which extends from an end face of the pinion drive shaft to form a cylindrical protective cover for a stopper fitted by the stop ring received in the groove and protruding from the end surface of the pinion drive shaft when the latter is retracted fully.

3 Claims, 3 Drawing Sheets

PINION STOPPER OF ENGINE STARTER

BACKGROUND OF THE INVENTION

The present invention relates to a pinion stopper of an engine starter and, particularly, to such a stopper of an engine starter of an overhang type in which a pinion is arranged outwardly of a bearing for supporting the pinion.

FIG. 3 shows, in cross-section, a pinion stopper of a conventional engine starter. In FIG. 3, a rotational force of an armature shaft 2 is transmitted through a planet reduction gear mechanism (not shown) to an output shaft 1. A pinion drive shaft 3 is arranged coaxially of the output shaft 1 and is adapted to be driven by the output shaft 1, through an over-running clutch 4. The pinion drive shaft 3 has an end on which a pinion 5 is formed integrally. The pinion drive shaft 3 has an axial through hole including a large diameter portion 9 extending from the end thereof to a predetermined depth which is connected by a step portion 10 and a small diameter portion to a space large enough to receive a spline of the output shaft 1. The pinion drive shaft 3 is supported slidably axially of the output shaft 1 by a bearing 7 mounted on a front bracket 6. Sleeve metals 8 are disposed between the output shaft 1 and the small diameter portion of the pinion drive shaft 3. It should be noted that the pinion drive shaft 3 is shown in FIG. 3 in a retracted state and a protruded state. That is, a portion of the pinion drive shaft 3 shown above the output shaft 1 shows the retracted state, and that portion below the output shaft 1 shows the protruded state, although the pinion drive shaft 3 is a single solid component.

As is shown, the pinion drive shaft 3 can be moved axially within a space 11 defined by the step portion 10 and a stopper 12 mounted on the end portion of the output shaft 1. The stopper 12 is in the form of ring, and whose axial position on the output shaft is defined by a stop ring 14 fitted in a ring groove 13 formed on the end portion of the output shaft 1. In FIG. 3, a lever 15 has one end connected to a plunger 16*a* of an electromagnetic switch 16 and the other end connected to a rear portion of the over-running clutch 4.

In operation, when an electric motor is supplied with a current from a starter switch (not shown) through the electromagnetic switch 16, the armature shaft 2 is rotated so that the output shaft 1 is driven. At the same time, the plunger 16*a* of the electromagnetic switch 16 is attracted to rotate the lever 15 so that the over-running clutch 4 and the pinion drive shaft 3 are moved forward until the step portion 10 of the drive shaft 3 contacts the stopper 12 where the pinion 5 on the pinion drive shaft 3 meshes with a ring gear of an engine to start the latter.

As mentioned, the stopper 12 and the associated stop ring 14 are disposed radially inward of an end portion of the pinion gear 5. In disassembling the starter for maintenance or repair of parts, the stopper 12 can be separated easily from the stop ring 14 and moved axially rearward of the output shaft 1 into the space 11 by using a suitable jig, and pushing it in a direction shown by an arrow A. However, since the stop ring 14 itself is fitted firmly in the ring groove 13 formed on the output shaft 1 and has to be pulled out from the narrow space 11 axially, a removal operation for the stop ring 14 is usually very difficult. That is, in a conventional engine starter, the module of the pinion gear 5 is 2.11 to 2.54 which means that a diameter of the dedendum of the pinion 5 is small, and the diameter of the output shaft 1 is 9 to 13 mm. Therefore, in order to give enough mechanical strength to the pinion gear 5, a distance between the output shaft 1 and an inner surface of the large diameter portion 9 of the pinion drive shaft 3 has to become very small. Consequently, the removal operation of the stop ring 14 becomes very difficult even when a specially designed plier is used.

SUMMARY OF THE INVENTION

An object of the present invention is to provide a pinion stopper of an engine starter in which a pinion stopper ring can be removed easily.

According to an aspect of the present invention, at least one axial groove is formed on an output shaft. The axial groove extends from an end of the output shaft to a stop ring groove, and has a depth substantially equal to that of the stop ring groove. A pin, or the like, is inserted along the axial groove into the stop ring, groove to push up the stop ring and the pin preferably has a hooked tip so that stop ring can be removed by pulling out the pin.

According to another aspect of the present invention, a stop ring groove is formed in a position on the output drive shaft adjacent to an end thereof, and an extension of a pinion drive shaft is provided which extends from an end face of the pinion drive shaft to form a cylindrical protective cover for a stopper fitted by a stop ring received in the groove and protruding from the end surface of the pinion drive shaft when the pinion is fully retracted.

DETAILED DESCRIPTION OF THE PREFERRED EMBODIMENT

Figure 1A:
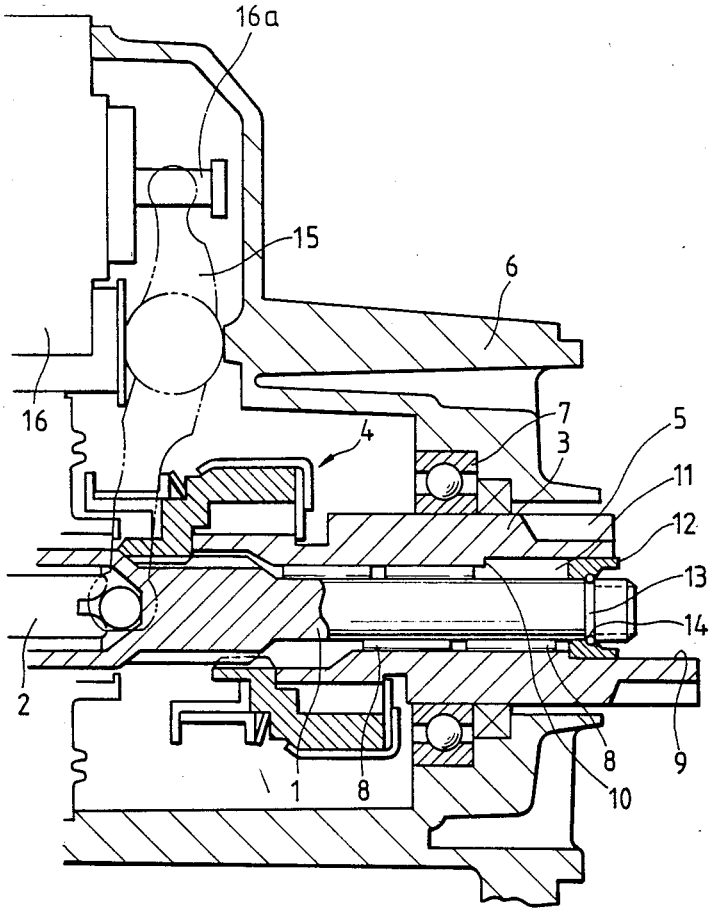
FIG. 1*a* is a cross-section of an embodiment of a pinion stopper according to the present invention.
Figure 1B:
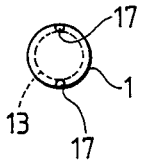
FIG. 1*b* is an end view of an output shaft of the embodiment shown in FIG. 1*a;*
Figure 3:
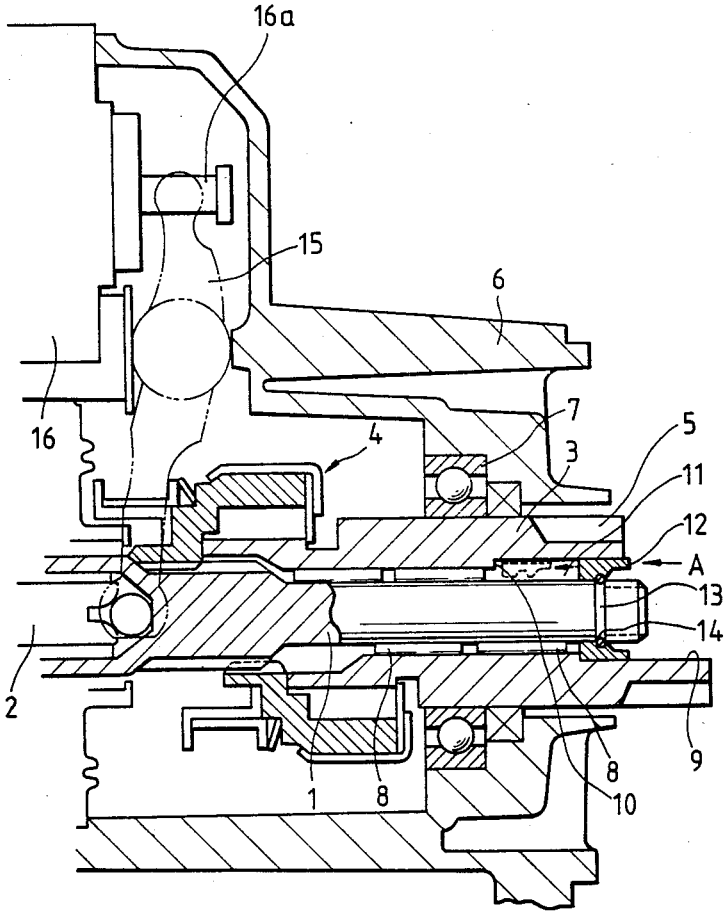
FIG. 3 PRIOR ART
FIG. 3 is a cross-section of a conventional pinion stopper.

FIG. 1*a* shows an embodiment of the present invention in cross-section. A difference between the present invention and the conventional stopper shown in FIG. 3 is that at least one axial groove 17 (two oppositely arranged grooves shown in (FIG. 1*a*) formed on an output shaft 1 which extends from an end thereof to a ring groove 13. The groove 17 has a depth large enough to allow a tip of a pin, or the like, to be inserted along the groove 17 to reach a bottom of the ring 14 fitted in a groove 13 so as to push up the groove 13. In the shown embodiment, the grooves 17 are separated angularly by 180° as shown in FIG. 1*b,* although the number and the positions of the axial grooves are selected arbitrarily.

In disassembling the stopper 12 and the stop ring 14 for maintenance, the stopper 12 is struck by a suitable jig rearwardly to separate it from the stop ring 14 after a drive shaft 3 is made fully retracted, so that the stopper 12 is moved into a space 11 defined by a step portion 10. Then, a pin-like tool having, preferably, a hook at a tip thereof, is inserted along the axial groove, or grooves, 17 to push up the stop ring 14 from the groove 13. Thereafter, by hooking the ring 14 and pulling it out along the output shaft 1, the ring 14 can be removed easily. Then, the stopper 12 is removed easily along the output shaft 1.

In the embodiment shown in FIG. 1*a*, an outward end of the stopper 12, when the drive shaft 3 is retracted fully, protrudes slightly from an outer end of a pinion gear 5 formed integrally with the drive shaft 3 so that the striking of the stopper 12 is facilitated. In order to protect such a protrusion of the stopper 12, it may be possible to provide an annular extension extending outwardly from an end face of the pinion gear 5.

Figure 2:
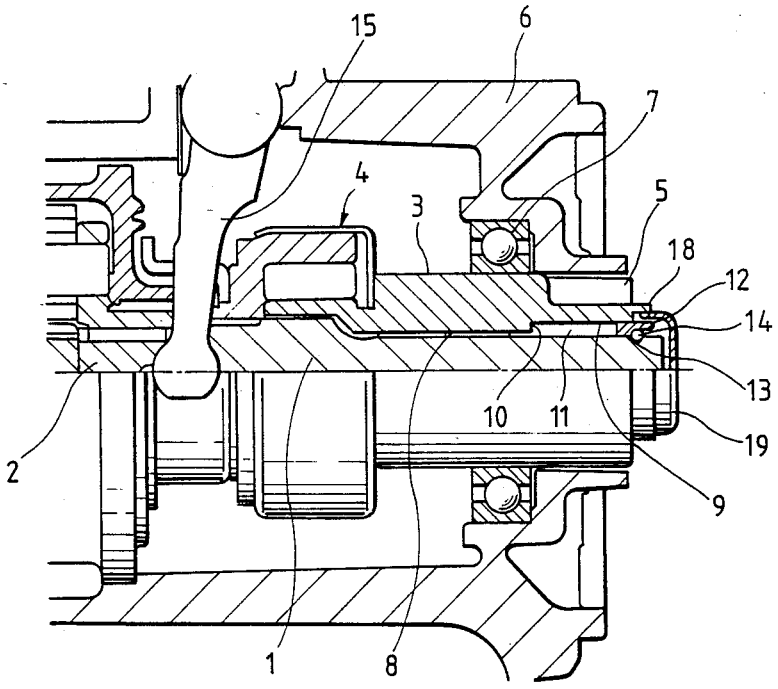
FIG. 2 is a cross-section of another embodiment of the present invention.

FIG. 2 shows another embodiment of the present invention which is formed with such a protective annular extension by boring a coaxial hole in the drive shaft 3, which has a larger diameter than that of the large diameter portion 9 of the through hole of the drive shaft 3. In FIG. 2, an annular extension 18 extends from the end face of the pinion gear 5 by a distance substantially equal to that of the protrusion distance of the stopper 12 to cover the stopper 12. By selecting the distance of the annular extension 18 suitably, it may be possible to position the stopper 12 closer to the top end of the output shaft 1. This may make the disassembling operation of the stopper easier and when this is the case, it is preferable to position the stop ring 14 in a plane including the end face of the drive shaft 3. In such a case, however, it may be necessary, in addition to the protection of the side portion of the stopper stopper 12 by the annular extension 18, to protect an outer end of the stopper 12 against mechanical shock and/or dust. In FIG. 2, a protective cap 19 is fitted in the annular extension 18 to cover the outer end of the stopper 12.

Although not shown in FIG. 2, the axial groove or grooves may be provided. However, when the position of the stopper 12 on the output shaft 1 is adjacent to the top end thereof, the disassembling operation which starts by removing the protective cap 19 might be performed easily even without such an axial groove or grooves.

As described above, according to the present invention, the removal of the stopper is facilitated.

What is claimed is:

1. A pinion stopper of an engine starter comprising an electric motor having an output shaft, a pinion drive shaft rotatably and axially slidably mounted on said output shaft, a pinion gear formed integrally with an outer end portion of said pinion drive shaft, a large diameer portion of a through hole formed in said pinion drive shaft, said large diameter portion extending from an outer end of said pinion drive shaft by a predetermined distsance to form a space, an annular groove formed in an outer end portion of said output shaft, a stop ring fitted in said annular groove and an annular stopper having a size allowing it to move along said output shaft freely within in said space and adapted to limit a relative movement of said pinion drive shaft to said output shaft when engaged with said stop ring fitted in said annular groove, said output shaft being formed with at least one axial groove extending from an outer end thereof to said annular groove so that said stop ring can be removed from said annular groove by a pin or the like inserted along said axial groove.

2. The pinion stopper as claimed in claim 1, wherein an annular extension is formed on an outer end face of said pinion drive shaft to cover an outer end portion of said stopper.

3. The stopper as claimed in claim 2, further comprising a protective cap adapted to be fitted in said annular extension to protect said outer end portion of said stopper against mechanical shock and/or dust.

* * * * *